US005912978A

United States Patent [19]

Eastty et al.

[11] Patent Number: 5,912,978

[45] Date of Patent: Jun. 15, 1999

[54] LOUDSPEAKER

[75] Inventors: Peter Charles Eastty, Oxford; Christopher Sleight; Peter Damien Thorpe, both of Oxon, all of United Kingdom

[73] Assignees: Sony Corporation, Tokyo, Japan; Sony United Kingdom Limited, Weybridge, United Kingdom

[21] Appl. No.: 08/979,754

[22] Filed: Nov. 26, 1997

[30] Foreign Application Priority Data

Nov. 27, 1996 [GB] United Kingdom ..... 9624669

[51] Int. Cl.[6] ..... H04R 25/00

[52] U.S. Cl. ..... 381/397; 381/412

[58] Field of Search ..... 381/396, 397, 381/412, 87, 111, 99, 182, 186

[56] References Cited

U.S. PATENT DOCUMENTS

| | | | |
|---|---|---|---|
| 4,625,328 | 11/1986 | Freadman | 381/111 |
| 4,811,403 | 3/1989 | Henricksen et al. | 381/87 |
| 5,325,435 | 6/1994 | Date et al. | 381/99 |
| 5,642,429 | 6/1997 | Janssen | 381/182 |

*Primary Examiner*—Huyen Le

*Attorney, Agent, or Firm*—Frommer Lawrence & Haug, LLP.; William S. Frommer; Dennis M. Smid

[57] ABSTRACT

A loudspeaker comprises a yoke; one or more vibration driving coils disposed so as to interact magnetically with the yoke when an electrical current flows through the coils; and one or more signal amplifying devices mounted on or near the yoke, the amplifying devices being operable to receive an input audio signal, to amplify the input signal to generate an amplified signal, and to supply the amplified signal to the vibration driving coils.

6 Claims, 1 Drawing Sheet

LOUDSPEAKER

BACKGROUND OF THE INVENTION

1. Field of the Invention

This invention relates to loudspeakers.

2. Description of the Prior Art

It is known to employ so-called "power DACs" (digital to analogue converters) to convert directly between a one-bit digital audio signal and an analogue signal of sufficient power to drive a loudspeaker.

However, these devices can give rise to electromagnetic interference problems from the cables linking the power DAC and the loudspeaker. This is partly because of the nature of the one-bit signal with its large spectral content at frequencies above the audio band, and so passive filtering is generally required between the power DAC and the loudspeaker.

SUMMARY OF THE INVENTION

This invention provides a loudspeaker comprising: a yoke; one or more vibration driving coils disposed so as to interact magnetically with the yoke when an electrical current flows through the coils; and one or more signal amplifying devices mounted on or near the yoke, the amplifying devices being operable to receive an input audio signal, to amplify the input signal to generate an amplified signal, and to supply the amplified signal to the vibration driving coils.

In a loudspeaker according to the invention, the signal amplifying devices (e.g. power transistors) are mounted directly on the loudspeaker yoke.

While this has advantages when used with analogue input audio signals (e.g. efficient heat conduction from the transistors, saving the weight of a separate heatsink in a powered loudspeaker), it is particularly advantageous with a one-bit digital audio input signal.

The signal path from the power transistors to the loudspeaker winding is very short indeed, so this can reduce EMF emissions. Also, in contrast to other power DAC schemes, there is a reduced need for passive filtering of the power-amplified one-bit digital audio signal; in fact, it may be that the filtering can be performed simply by the loudspeaker winding.

In a further preferred feature, the one-bit signal could be pre-filtered in the digital domain to provide crossover functions (sending different audio signal bands to different loudspeakers within a cabinet). Each of the loudspeakers (e.g. a woofer or tweeter) could then have its own power transistors mounted on its yoke.

This invention also provides a loudspeaker system for generating an audible signal from a one-bit digital audio input signal, the loudspeaker system comprising: two or more loudspeakers as defined above; and a crossover for digitally filtering the input one-bit digital audio signal into two or more filtered one-bit signals representing different audio frequency bands, a respective filtered one-bit signal being supplied as an input signal to each of the two or more loudspeakers.

This invention also provides a loudspeaker unit comprising: a housing; and a loudspeaker system as defined above and/or a loudspeaker as defined above, disposed within the housing.

The above, and other objects, features and advantages of this invention will be apparent from the following detailed description of illustrative embodiments which is to be read in connection with the accompanying drawings.

DESCRIPTION OF THE PREFERRED EMBODIMENTS

Figure 1:
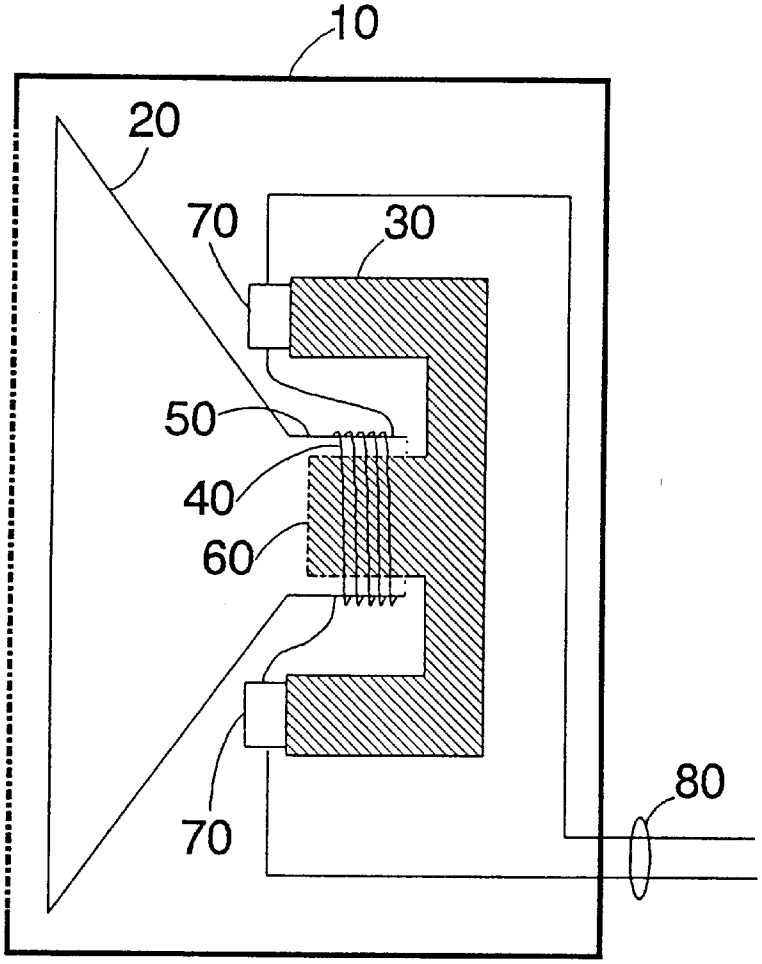
FIG. 1 is a schematic diagram of a loudspeaker.

FIG. 1 is a schematic diagram of a loudspeaker. The loudspeaker comprises a housing 10 containing a cone 20 and a metal yoke 30.

The loudspeaker is of the moving coil type, so a coil 40 is wound around a tubular part 50 of the cone. The tubular part 50 extends around a projection 60 of the yoke 30.

The yoke 30 is a permanent magnet, and so as an electric current passes through the coil 40, the magnetic field of the coil interacts with the permanent magnetic field of the yoke 30 to cause movement of the cone 20 with respect to the yoke 30. This is how the loudspeaker generates sound from an electrical signal.

The electrical current through the coil is provided by two power transistor amplifying devices 70 which are mounted on the yoke 30. In this way, the yoke 30 acts as a heatsink for the power transistors 70. The power transistors 70 receive an input audio signal on input wires 80 and a direct current (DC) power supply on separate power connectors (not shown).

In this embodiment, the electrical signal supplied on the input connectors 80 is a one-bit digital audio signal, for example a one-bit digital audio signal at a sampling rate of 64 fs (where fs may be, for example, 48 kHz or 44.1 kHz), although in other embodiments a conventional analogue audio signal could be supplied to the power transistors 70.

A feature of a one-bit digital audio signal is that if the signal is low-pass filtered to exclude components outside of the audio band (i.e. filtered to remove components above the audio band), the resulting signal is a recovery of the analogue audio signal which was represented by the one-bit digital signal.

So, the one-bit digital signal can be amplified directly by the power transistors 70 and supplied to the coil 40, so long as there is sufficient low-pass filtering in the system to remove unwanted frequency components. (Here it is noted that it is not necessary to remove such components entirely, but a reduction can help with the sound quality and electromagnetic interference properties of the system.)

In this embodiment, the low-pass filtering is achieved in three ways: through the inductance of the coil 40 providing an impedance which increases with frequency, and through the mechanical response of the loudspeaker's moving parts themselves.

So, this arrangement provides a loudspeaker which can be supplied directly with a one-bit digital audio signal, and which can reproduce the signal as sound without the need for conventional digital-to-analogue conversion or passive filtering between the power transistors 70 and the coil 40 (although passive filtering could be inserted there if required). The yoke 30 provides a heatsink for the power transistors 70, and indeed as the vibrations of the loudspeaker cone 20 increase, there is also likely to be an increase in airflow over the power transistors 70.

Figure 2:
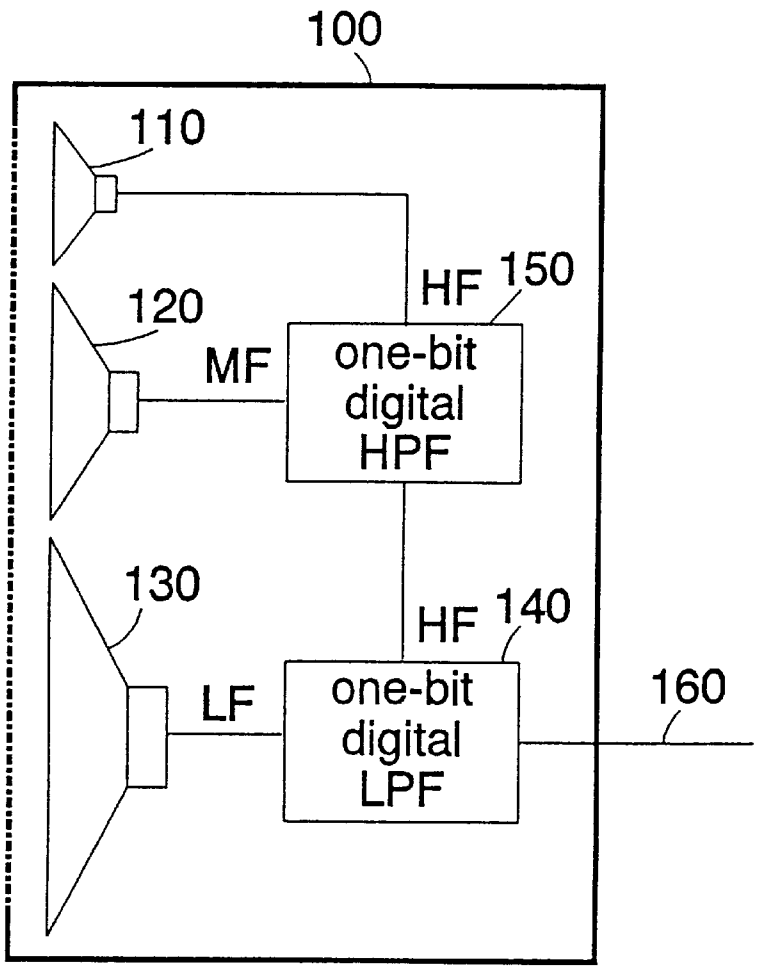
FIG. 2 is a schematic diagram of a loudspeaker enclosure containing three loudspeakers.

FIG. 2 schematically illustrates a loudspeaker enclosure 100 containing three loudspeakers 110, 120, 130 of the type shown in FIG. 1 (but without individual enclosures 10). In particular, the loudspeaker 110 is a tweeter unit (small physical size, high frequency response); the loudspeaker 120 is a mid-range unit; and the loudspeaker 130 is a woofer (large physical size, low frequency response).

In a conventional (wholly analogue) loudspeaker system, a filter known as a crossover is used to separate the analogue audio signal into frequency bands best suited for reproduction by woofers, tweeters and (if present) mid-range units.

In contrast, in the system shown in FIG. 2, the filtering can be performed in the one-bit digital domain by a pair of filters 140 and 150.

In particular, the filter 140 filters an incoming one-bit digital audio signal 160 into a low frequency component (supplied to the woofer 130) and a high frequency component (supplied to the filter 150). In turn, the filter 150 filters the high frequency component from the filter 140 into upper and lower frequency bands, namely a high frequency band (for supply to the tweeter 110) and a mid-frequency band (for supply to the mid-range unit 120).

This arrangement provides the function of a crossover unit, but instead of using expensive analogue filters, the crossover function can be achieved with potentially cheaper and more easily reproducible digital filters.

Although illustrative embodiments of the invention have been described in detail herein with reference to the accompanying drawings, it is to be understood that the invention is not limited to those precise embodiments, and that various changes and modifications can be effected therein by one skilled in the art without departing from the scope and spirit of the invention as defined by the appended claims.

We claim:

1. A loudspeaker comprising:

a yoke;

at least one vibration driving coil disposed so as to interact magnetically with said yoke when an electrical current flows through said at least one vibration driving coil; and at least one signal amplifying device mounted on said yoke in a manner such that said yoke acts as a heat sink for the at least one signal amplifying device so as to provide heat dissipation without the use of a separate heat sink element, said at least one amplifying device being operable to receive an input audio signal, to amplify said input signal to generate an amplified signal, and to supply said amplified signal to said at least one vibration driving coil.

2. A loudspeaker according to claim 1, in which said input audio signal is a one-bit digital audio signal.

3. A loudspeaker according to claim 2, comprising a digital filter for digitally filtering said one-bit digital audio signal to be supplied to said at least one signal amplifying device.

4. A loudspeaker according to claim 1, in which said at least one signal amplifying device includes a power transistor.

5. A loudspeaker system for generating an audible signal from a one-bit digital audio input signal, said loudspeaker system comprising:

two or more loudspeakers according to claim 1; and a crossover for digitally filtering said input one-bit digital audio signal into two or more filtered one-bit signals representing different audio frequency bands, a respective filtered one-bit signal being supplied as an input signal to each of said two or more loudspeakers.

6. A loudspeaker unit comprising:

a housing; and a loudspeaker system according to claim 5 or a loudspeaker according to claim 1, disposed within the housing.

* * * * *